United States Patent [19]

Paules et al.

[11] Patent Number: 4,946,723

[45] Date of Patent: Aug. 7, 1990

[54] TAMPER-PROOF SEALING STRIP WITH A TEAR TAB AND A CONTAINER

[76] Inventors: Eugene H. Paules, 24 Willard Rd., Huntington, Conn. 06484; Denis E. Bruggeman, RR1, Box 25, Colton, S. Dak. 57018

[21] Appl. No.: 269,064

[22] Filed: Nov. 9, 1988

[51] Int. Cl.[5] ..... B32B 3/30

[52] U.S. Cl. ..... 428/43; 428/167; 428/906; 206/606; 206/608; 206/612

[58] Field of Search ..... 428/40, 43, 906, 167; 206/608, 606, 612; 220/270, 276

[56] References Cited

U.S. PATENT DOCUMENTS 2,773,634 12/1966 Negoro ..... 206/612

FOREIGN PATENT DOCUMENTS 722518 1/1955 United Kingdom ..... 206/606

*Primary Examiner*—Alexander S. Thomas

[57] ABSTRACT

A sealing strip with a tear tab and tear strip for the sealing strip, also in combination with a container, including an embodiment to a sealing strip for hermetically sealing a container, as well as a tamper-evident container sealed with said sealing strip.

12 Claims, 2 Drawing Sheets

FIG. 1
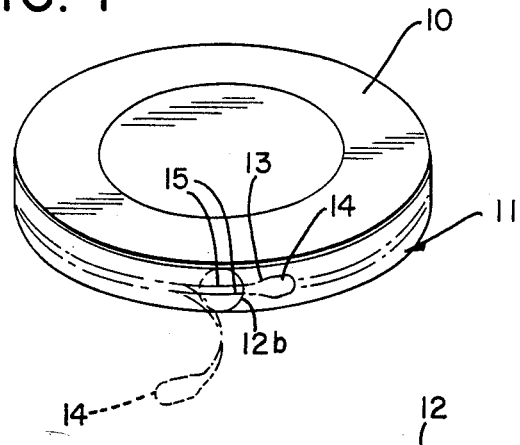
FIG. 2
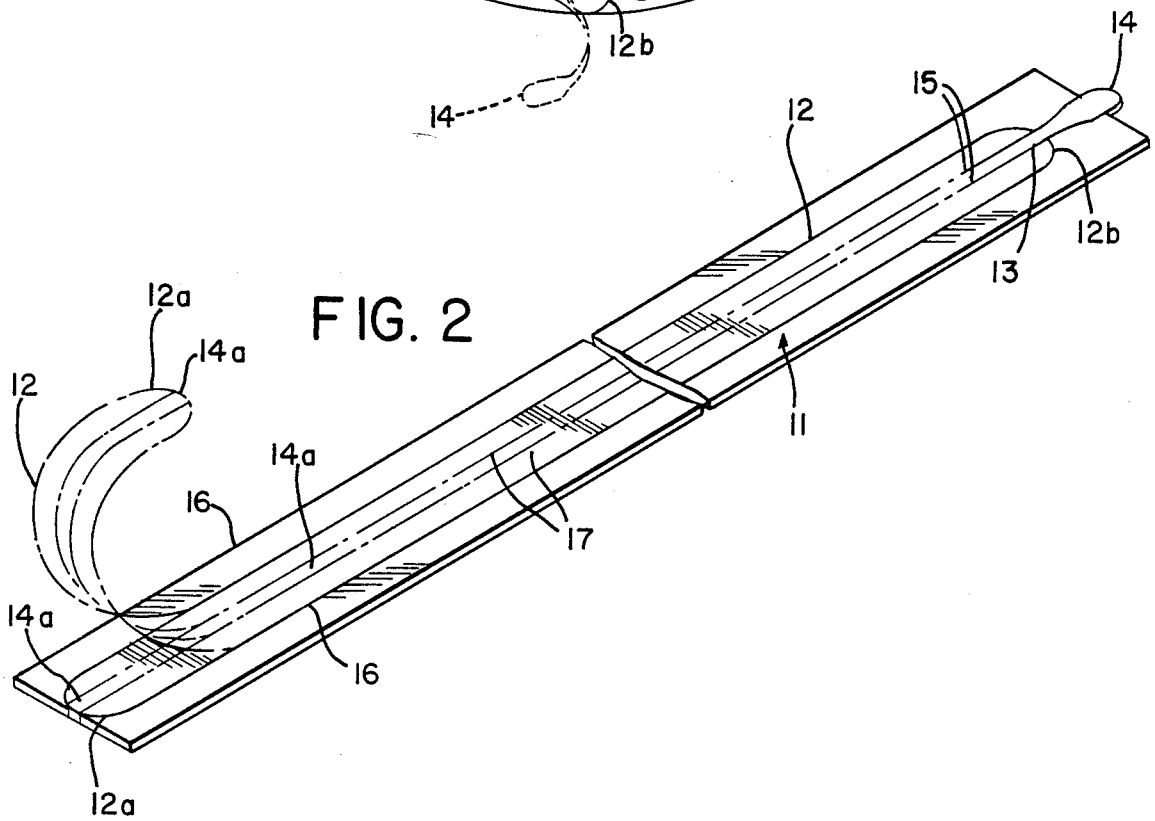
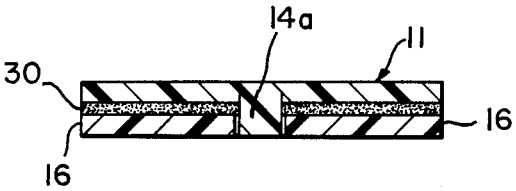
FIG. 3
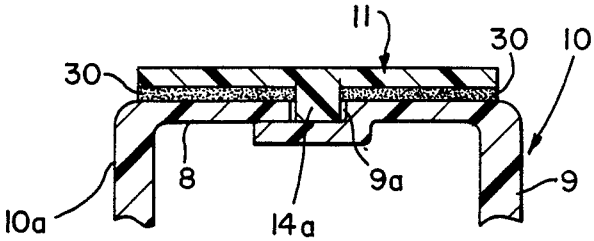
FIG. 4

FIG. 5
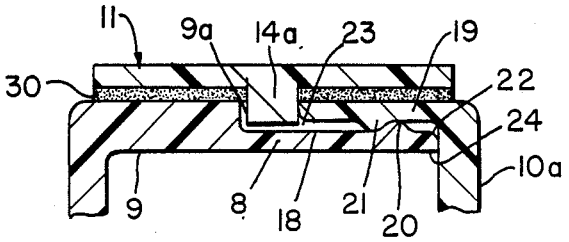
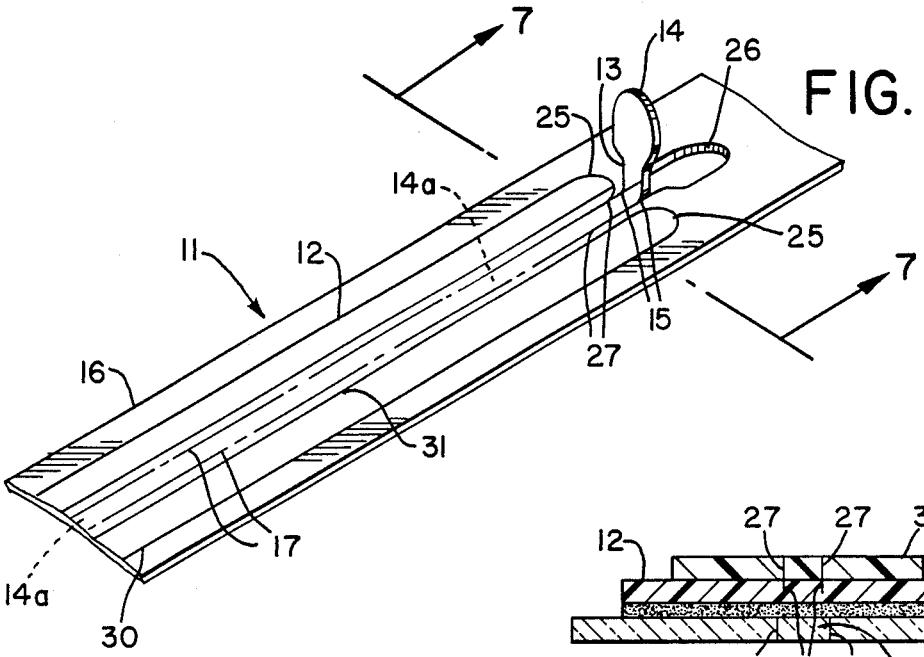
FIG. 6
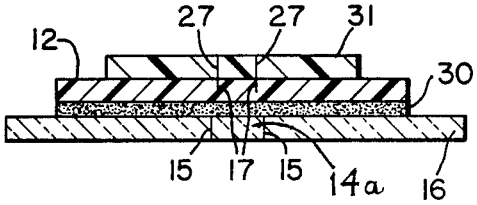
FIG. 7
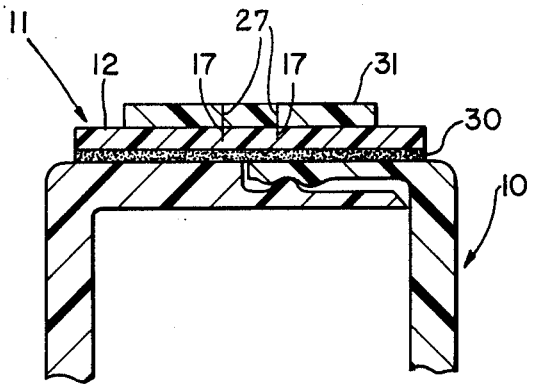
FIG. 9
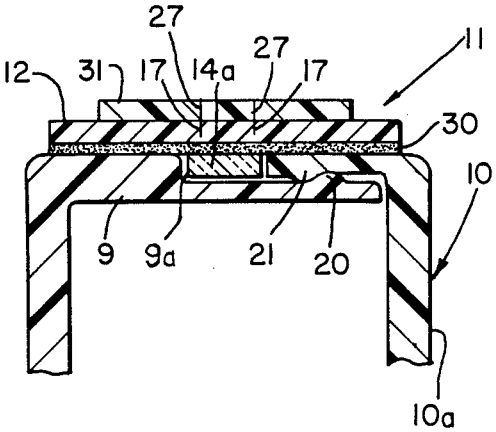
FIG. 8

TAMPER-PROOF SEALING STRIP WITH A TEAR TAB AND A CONTAINER

This invention relates to tamper-evident closures, such as tamper-evident closures sealed with a sealing strip having a tear tab and tear strip. Further, this invention relates to tamper-evident closures, such as sealed with sealing strips, and a container specifically adapted for sealing said closures.

Further, tamper-evident, sealed closures for a container which prevent intrusion of the surrounding atmosphere are also disclosed as a further embodiment, as is a container adapted for said tamper-evident, sealed closures, hermetically sealed with a sealing strip provided with a tear tab.

BACKGROUND FOR THE INVENTION

It is well known that various containers for goods must have a lid which seats securely and positively. A lid for such a container is necessary so that the goods, when transported, do not dislodge the lid; or the goods, when displayed, indicate a non-tampered condition. A non-tampered or a tampered condition can thus be established by the "tamper-evident" closure.

In order to mass produce such containers, the lid and the body of the container must be so shaped as to allow proper seating of the lid on the container. Typically, today's small size containers are produced from plastic materials which have a reasonably good flexibility. Plastic materials allow diverse shaping of the container body for reception of the lid, as well as the shaping of a complementary lid.

A typical example of such plastic container is described in U.S. Pat. 4,646,933, which discloses various arrangements for seating a lid on a container, as well as for providing positive venting and sealing of such containers.

When placing a seal around such container or providing a tamper-evident closure, it is necessary that a sealing strip is properly seated on the container. Moreover, it is necessary that the closure seal, such as a sealing strip with a tear tab and a tear strip, is precisely placed on the container. It is also necessary that the sealing strip be properly placed on the container at high speed. A novel machine for circumferentially proper placement of a seal on a container is disclosed in U.S. Pat. No. 4,657,622. This patent and the previously mentioned patent are incorporated by reference herein.

As a consequence of the high speed production cycles needed for today's competitive packaging, the sealing strips must be spoolable in fairly large diameter spools. Thus, it now requires that the pressure-sensitive, spooled closure seals are properly carried on a carrier strip so as to allow proper high speed sealing of a closure on a container.

Tear tabs which embody a tear strip or strings have, according to the prior art, a fairly thick central section for the tear strip or string. Various layers which are used for the sealing of the closure make it difficult to place accurately a seal on such containers or to seal properly such containers, because the spooled sealing strip is displaced sideways as the spool is wound up.

As the initial sealing strip placement on a container must be very accurate and as the sealing strip must be peeled away from a carrier strip, improper sideway displacement and movement greatly affects the sealing strip location on a container.

Hence, the present invention is to eliminate and/or minimize the above recited problems.

Various embodiments disclosing prior art sealing tabs or sealing strips have been shown in the art, and Applicants are aware of the following sealing devices, tabs or strips: U.S. Pat. No. 1,032,026 dated July 9, 1912 to E. H. Roden; U.S. Pat. No. 1,180,541 dated Apr. 25, 1916 to E. H. Roden; U.S. Pat. No. 2,120,629 dated June 14, 1938 to H. Schunemann; U.S. Pat. No. 3,089,634 dated May 14, 1963 to H. L. Heise et al.; U.S. Pat. No. 3,300,118 dated Jan. 24, 1967 to E. E. Owens; U.S. Pat. No. 3,853,261 dated Dec. 10, 1974 to N. H. Moore; U.S. Pat. No. 3,873,018 dated Mar. 25, 1975 to James A. Donnay; U.S. Pat. No. 4,009,793 dated Mar. 1, 1977 to Minesinger et al; U.S. Pat. No. 4,091,929 dated May 30, 1978 to Bruce E. Krane; U.S. Pat. No. 4,637,943 dated Jan. 20, 1987 to G. D. Bennett; U.S. Pat. No. 4,647,485 dated Mar. 3, 1987 to Roy E. Nelson.

The above devices are not believed to disclose the unique sealing strip and carrier utilization or the sealing strips disclosed herein as articles of manufacture, or the sealed container in combination with the sealing strip as an article of manufacture.

BRIEF DESCRIPTION OF THE PRESENT INVENTION

In accordance with the present invention, sealing strip embodiments have been discovered which provide spoolable sealing strips, including sealing strips with a tear tab and a tear strip therefor.

According to the present invention, one embodiment shows the tear tab and its tear strip as part of the sealing strip carrier.

After seating of the sealing strip on the closure for a container, the exposed tear tab with a tear strip conveniently identifies, or makes evident, any tampering of the container by a mere observation of the container.

Further, the container can now be readily opened by merely pulling on the tear tab which allows the tear strip to sever a pre-scored portion of the entire sealing strip, and thus to remove the seal. Such manipulation provides a ready opening of the container and the removal of the lid therefrom. Hence, an improved article of manufacture has been provided in the form of a sealing strip and said sealing strip in combination with a carrier.

As another embodiment of the above described invention, a sealing strip for a closure as described before, is further used in combination with a specifically designed container which allows now a high speed sealing of containers. The container configuration is integrated with the sealing strip to provide for a container closure in such a manner as to allow the use of spoolable, high speed, yet accurate, sealing strip placement on a container.

Still another embodiment shows a sealing strip which seals the overlapping portions of the sealing strip on a container body and container lid so as to prevent ingress into the container of the ambient atmosphere or conversely, to prevent egress of the volatile contents of the container.

As a still further and different embodiment, a sealing strip in combination with a carrier for forming a tear tab from a carrier and a sealing strip carrier combination has been disclosed. In this embodiment, a tear strip functions differently from the previous embodiments.

Moreover, yet another spoolable sealing strip embodiment has been disclosed which shows a tear strip and an optional overlay strip for the tear strip, pre-scored from the top, for removal of the tear strip from the sealing strip when used with a container.

Thus, in combination with the container as further disclosed herein, the present invention allows for a substantially hermetical sealing of containers by means of the tamper-evident sealing strips.

DETAILED DESCRIPTION OF THE INVENTION, THE VARIOUS EMBODIMENTS THEREOF, AND THE DRAWINGS

With reference to the drawings herein which describe the invention and various aspects thereof, and wherein:

FIG. 1 discloses in a perspective view a container with a closure sealed with a sealing strip;

FIG. 2 illustrates in a perspective view a sealing strip used for the container in FIG. 1, showing somewhat schematically a partially peeled away sealing strip;

FIG. 3 illustrates a cross-section of the sealing strip shown in FIG. 2, wherein a carrier strip is co-extensive with the sealing strip;

FIG. 4 illustrates in a partial cross-section a container as shown in FIG. 1, and the tamper-evident sealing means therefor;

FIG. 5 shows in greater detail a tamper-evident sealing strip in combination with a container advantageously designed for proper seating of a container lid;

FIG. 6 illustrates in a perspective view another embodiment of the sealing strip wherein the sealing strip is being carried on a carrier strip;

FIG. 7 shows in cross-section along lines 7—7 of FIG. 6 the sealing strip shown in FIG. 6 with a sealing strip component parts illustrated in cross section;

FIG. 8 illustrates in a partial cross-section the sealing strip shown in FIGS. 6 and 7 as placed on a closure for container; and FIG. 9 illustrates in cross-section still another spoolable sealing strip pre-scored on top of it with an optional overlay layer likewise pre-scored for use on a container.

Turning now in greater detail to the embodiments shown in FIGS. 1 to 9, FIG. 1 illustrates the container 10 having placed thereon a sealing strip 11. As shown in FIG. 2, sealing strip 11 consists of an elongate body 12 and round end portions 12*a* and 12*b* therefor; end portion 12*b* carries a tear tab 14 which has a narrowed neck 13 terminating in tear strip 14*a*. Cut lines 15 are on both sides of the neck 13 portion of sealing strip 11.

Tear strip 14*a* is thus interconnected to neck 13 and tear tab 14. Tear strip 14*a* is scored along score lines 17, shown as extending for the entire length of sealing strip elongate body 12. Upon application to a container 10, sealing strip 11 is removed from carrier 16. That is, carrier 16 is in a form of a Mylar film, as is the sealing strip elongate body 12. Other like plastic films may be used, such as vinyl, vinyl acetate, etc., but Mylar is preferred. Sealing strip 11 is readily peeled back from carrier 16, as shown for illustration purposes in FIG. 2. Tear strip 14*a* is thus part of the carrier 16 and now sealing strip 11. As it is evident from FIG. 2, sealing strip end 12*a* is first applied to container 10.

Carrier 16 may be of various widths depending on the machinery employed and may be as narrow as the sealing strip 11 or wider as needed for spooling and/or feeding purposes in a suitable machinery. Carrier 16 typically is a film of a thickness from about 1 mil to 3 mils, typically 1½ to 2 mils. The sealing strip 11 is typically a film of a thickness from about 2 to 6 mils, preferably 3 to 4 mils.

Consequently, in FIG. 3 in a cross-section a tear strip 14*a* is shown as being part of the carrier 16 when carrier 16 has not yet been unpeeled from the sealing strip 11. In FIG. 4, a container such as 10, shown in FIG. 1 in partial cross section, having a container body 9 and a lid 10*a*, has been illustrated. The tear strip 14*a*, as shown therein, is seated in a groove 9*a* formed between the lid 10*a* and the container body 9, as will be further explained herein, in a sealed, adhering relationship. An adhesive layer 30 is shown in FIGS. 3 and 4. Typically, such adhesives may be vinyl acetates and vinyl esters, e.g., vinyl butyrates and various acrylates and epoxies. Carrier 16 may also be pretreated with a conventional release agent for such adhesives for facile peeling of the sealing strip 11 from carrier 16.

In FIG. 5, container body 9 and its lid 10*a* are illustrated in greater detail in combination with the sealing strip 11. As a sealed closure is part of the invention herein, this illustration shows the advantages of the combination. Accordingly, tear strip 14*a* is seated in the groove 9*a* formed adjacent to the necked down portion 8 of a container lip 18. Container lip 18 has a sealing protrusion 20 circumferentially exteriorly around the container lip 18. A cam section 22 at the end of the container lip 18 terminates in a sealing point 24 which abutts against the lid 10*a*, as shown in FIG. 5. The lid 10*a* in turn, has a container lip engaging portion 19, carrying on the interior thereof, close to the edge of the lid 10*a* a complementary lid protrusion 21. Lid protrusion 21 engages sealing protrusion 20, the latter biasing and holding container lid 10*a* securedly against point 24 of container lip 18.

The container lip engaging portion 19 of the lid 10*a* also has a cam section 23 which allows for guided engagement of the lid 10*a* with the cam section 22 for the container lip 18. At the same time, sealing point 24 prevents the lid 10*a* from covering the entire length of container lip 18.

In FIG. 6, another embodiment is shown in combination with that shown in FIG. 7. These will be explained conjointly.

As shown in FIG. 6, the carrier 16 has a punched out hole 26 in which the tear tab 14 is seated. Tear tab 14, formed from carrier 16, is adhesively attached to sealing strip 11. On top of the carrier 16 is the elongate body 12 of sealing strip 11 with one of the end portions for the embodiment shown in FIG. 6 being slightly different from that shown in FIG. 2 and, therefore, labeled as 25, as shown in FIG. 6. Thus, the neck 13 of tear tab 14, shown in FIG. 6, has two bottom cut lines 15 and two top or overlay score lines 27, that is, top score lines 27 fully cuts, at the end portion 25, the overlay strip 31 and, partially, the elongated body 12 of the sealing strip 11, as shown in FIG. 7. The integrity of the seal is preserved because the circumferentially length of the sealing strip 11 overlaps at the end portions wherein the sealing strip 31 has only top score lines 27 along the longitudinal length of the sealing strip- 11, as shown in FIG. 6. Bottom cut lines 15 cut the carrier 16, as further shown in cross section of FIG. 7. Away from the end portion 25, the tear strip 14*a* score lines 17 join the overlay score lines 27, also as shown in FIG. 7. Thus, top score lines 27 cut the overlay strip 31 and bottom cut lines 15 cut carrier 16, such as to provide positive entry into score lines 17 in the tear strip. In this embodiment, score lines 17 do not start from end portion 25, but slightly further away from end portions 25 so as to provide the proper sealing function As shown in FIG. 7 in cross section along lines 7—7 of FIG. 6, the overlay layer 31 protects the score lines 17 of tear tab string 14*a*. Further, as shown in FIG. 7, carrier 16, as amplified in FIG. 6, is the precursor basis for tear tab 14, which does not have any adhesive on the bottom thereof. Tear tab strip 14*a* is formed from and is part of carrier 16 and, including tear tab 14, not shown not carrying the adhesive 30 thereon. The overlay layer 31 still protects the tear tab strip 14*a* from ambient atmosphere intrusion, and, in an alternate embodiment; top score lines 27 may be just slightly scored, not shown, as well as score lines 17. Therefore, top score lines 27 facilitate the removal of tear tab strip 14*a*. Still further, overlay layer 31 is doubly protecting against air intrusion into the container in the overlap area shown in FIG. 1 by a phantom line for the sealing strip 11.

In the partial cross section in FIG. 8, the embodiment shown in FIGS. 6 and 7 is placed on the lid of the container 10 with a groove space 9*a* between the container body 9 and its lid 10*a*. The tear strip 14*a* is made from the carrier 16 and is positioned in the groove 9*a*.

In a further embodiment shown in FIG. 9, the tear strip 14*a* is pre-scored with tear strip 14*a*score lines 17 from the top of the sealing strip 11. Top pre-scoring still assures a sealing of contents in container 10, but now makes it adaptable for various containers with or without a groove 9*a*. Moreover, an overlay strip 31 need not be used, although it has been found to be desirable, especially if of a different color for color contrast to indicate a tamper-evident container. Of course, if printing of the sealing strip is desired with a different striping, such printing may also be used. The overlay strip 31, when used with the previously disclosed embodiments, should be of a different color and, when torn by tear strip 14*a*, should provide an appropriately ragged edge which shows up as a color contrast. Therefore, typically overlay strip 31 may be fairly thin, i.e., from 1/3 to ⅓ the thickness of sealing strip 11. For sake of clarity in the drawings, overlay strip 31 has not been shown to scale. For the embodiment shown in FIG. 9, the ends of the sealing strip may be the same as shown in FIG. 2 or FIG. 6.

For the embodiment shown in FIG. 9, the sealing strip 11 is made of polyvinyl chloride strip, and the overlay strip 31 likewise of polyvinyl chloride, or Mylar or similar material.

Having thus described the above embodiment, it is clearly illustrated that in the first embodiment shown in FIG. 2 the tear tab iq embedded in the groove 9*a* and helps in guiding sealing strip 11 around lid 10*a*, whereas in the embodiment shown in FIGS. 6 and 7, a tear strip is part of the elongate body 12 of sealing strip 11, but tear tab 14 itself is formed from the carrier 16 so as not to carry any adhesive on tear tab 14 or in the vicinity of the neck 13, or at the very junction of neck 13 with tear tab 14 At the same time, tear tab 14 and tear string 14*a*are independent of container 9 configuration. This, groove 9*a* may be placed on lid 10*a* and container 9 at any reasonable position (or be used with containers having no groove), yet over the area which is most apt to allow ingress of air or the ambient atmosphere into the container For the embodiment shown in FIG. 9, the tear tab 14 being part of the sealing strip 11 must carry an adhesive-deadened undercoating on tear tab 14 which is applied during the formation of the sealing strip 11, but before placement of the same on the carrier 16.

As it is evident from the discussion above, the carrier 16 has a significant function for the proper formation of a sealing strip 11. In one embodiment shown in FIGS. 1 to 5, the carrier provides a tear strip 14*a* for the sealing strip 11. In another embodiment shown in FIGS. 6 to 8, the carrier provides only the tear tab 14.

Finally, in FIG. 9 the carrier is functioning as a carrier without a sealing strip formation function. However, because of pre-scoring from top of sealing strip 11, a viable tear strip 14*a* and sealing strip which properly seals a container is provided.

In all cases the carrier and sealing strip are readily spoolable and dimensionally stable for proper, high speed placement of sealing strips 11 on a container.

When the closure for the container is sealed as illustrated above, any tampering with the closure is evident from the mere inspection of the sealing strip 11. The sealing strip 11 may not be removed intact, as the score lines 17, in combination with the tightly adhering adhesive, prevent the removal of the entire strip. Moreover, bottom cut lines 15 and/or top cut lines 27 in the sealing strip 11 prevent any removal of the sealing strip 11 in the overlapped portion of the sealing strip and thus indicate a tampered condition had such tampering occurred.

Likewise, any tear of the sealing strip 11 caused by tear tab strip 14*a*is indicated, especially when a highly reflective sealing strip, such as gold or silver coated Mylar, is being used. Further, a two color combination also shows up tampering with a contrasting color, especially when the sealing strip 11 is different in color from that of the container 10 or tear tab strip 14*a*, or when the ragged edges on a tear tab in sealing strip 11 are left there by a tampering with tear strip 14*a*, such as is evident with highly reflective, contrasting coatings on the sealing strip 11 or overlay strip 31

What is claimed is:

1. A spoolable sealing strip and a carrier therefor, wherein said combination comprises: a sealing strip; an adhesive layer on an underside of said sealing strip; a tear strip for said sealing strip; a tear tab for said tear strip; said tear tab and tear strip pre-scored for removal from said carrier and adheringly affixed to said sealing strip onto the outermost exterior surface of said tear tab and tear strip; and a pair of bottom score lines in said sealing strip for a length thereof corresponding to said tear strip short of an exterior surface of said sealing strip.

2. The combination as defined in claim 1, wherein a pair of cut lines are in an end of said saling strip proximate to said tear tab and tear strip.

3. The combination as defined in claim 1, wherein said tear tab and tear strip are integrally cut from said carrier.

4. The combination as defined in claim 1, wherein said sealing strip ends are of a rounded configuration for overlap definition when said sealing strips are on a container.

5. The combination as disclosed in claims 1, wherein an overlay layer is affixed to the outermost surface of said sealing strip.

6. The combination as defined in claim 1, wherein said carrier is Mylar, whereby it provides dimensional stability when said carrier and sealing strip are spooled on or from a spool.

7. A sealing strip for a container, as defined in claim 1.

8. A spoolable sealing strip and a carrier therefor, wherein said combination comprises:

a sealing strip;

an adhesive layer on an underside of said sealing strip;

a carrier for said sealing strip;

a tear tab for said sealing strip comprised of a carrier portion, a sealing strip layer affixed to the outermost surface of said carrier portion and therebetween an adhesive layer; and a tear strip interconnected to said tear tab via said sealing strip, said tear strip defined by said sealing strip and a pair of parallel score lines in said sealing strip upwardly from said innermost surface of said sealing strip.

9. The spoolable sealing strip as defined in claim 8, wherein the same includes a pair of cut lines in the carrier layer and spatially outside of said parallel score lines.

10. The spoolable sealing strip as defined in claim 8, wherein the same includes a second pair of parallel cut lines proximate to said tear tab and into said tear strip.

11. The spoolable sealing strip as defined in claims 8, wherein the same has an overlay layer affixed to the outermost surface of said tear strip.

12. A sealing strip for a container as defined in claim 8.

* * * * *